United States Patent [19]

Judkins et al.

[11] 4,366,692

[45] Jan. 4, 1983

[54] FASTENER STRIP FOR BUILDING WALL CONSTRUCTIONS

[75] Inventors: Thomas E. Judkins, Baltimore; Thomas J. Stanton, Ellicott City, both of Md.

[73] Assignee: The Judkins Associations, Inc., Baltimore, Md.

[21] Appl. No.: 187,708

[22] Filed: Sep. 16, 1980

[51] Int. Cl.[3] ..... B21D 31/02

[52] U.S. Cl. ..... 72/186; 72/177

[58] Field of Search ..... 72/177, 186; 52/309.2, 52/309.7, 309.11, 410, 714, 735; 428/595, 597

[56] References Cited

U.S. PATENT DOCUMENTS

| | | | |
|---|---|---|---|
| 2,003,448 | 6/1935 | Kruse | 72/177 |
| 2,089,326 | 8/1937 | Bailey | 72/186 |
| 2,284,422 | 5/1942 | Hall | 52/735 |
| 3,421,281 | 1/1969 | Harris | 52/735 |
| 3,427,847 | 2/1969 | Harper | 72/186 |
| 3,896,650 | 7/1975 | O'Konski | 72/186 |

*Primary Examiner*—Lowell A. Larson
*Attorney, Agent, or Firm*—Larson and Taylor

[57] ABSTRACT

A fastener strip is provided which is utilized in a building wall construction comprising sheets of foamed plastic such as polystyrene affixed to a concrete wall and covered by panels of gypsum or the like. The fastener strips are positioned over the foamed sheeting and assist in nailing the sheeting to the wall. The cover panels are screwed to the fastener strips. The fastener strips comprises a relatively thin, generally planar strip of material which includes a plurality of reinforcing ribs therein to provide strengthening of the strip and a series of teeth cut out of the body of the strip for engaging the foamed sheeting so as to hold the strip in the appropriate position for nailing. The teeth are formed simultaneously with rolling of the fastener strip from a roll-forming machine.

4 Claims, 8 Drawing Figures

FASTENER STRIP FOR BUILDING WALL CONSTRUCTIONS

FIELD OF THE INVENTION

The present invention relates to an improved fastener strip for building wall constructions wherein sheets of a foam material are secured to a wall by nails or the like extending through fastener strips and the associated foam sheets, and the fastener strips also serve as studs to which covering panels fabricated of gypsum or the like are affixed.

BACKGROUND OF THE INVENTION

There is disclosed in U.S. Pat. No. 3,401,494 (Anderson) a building wall construction of the type referred to above. In this construction, U-shaped metal fasteners or studs (also referred to as furring channels) are provided the legs or flanges of which include serrated edges that permit the fasteners to be pressed into polystyrene foam sheets. Thereafter, nails or pins driven through metal studs are used to secure the studs, and thus the polystyrene sheets, to a concrete wall. The metal studs provide a backing to which panels of gypsum are secured, the gypsum panels being screwed into the metal studs and thus supported thereby.

Although the studs or fasteners of the Anderson patent take several forms, each is relatively expensive to manufacture, at least as compared with the fastener of the present invention. For example, the fasteners must be made of reasonably heavy duty metal in order to maintain the shapes (U-shaped channel or other specialized shapes) contemplated therein and substantially more handling is required than with the fastener of the present invention.

Other patents of possible interest include U.S. Pat. Nos. 1,562,784 (Olsen); 1,328,201 (Rendano); 1,389,866 (Georgeson et al); 3,106,751 (Fish); 3,394,516 (Taylor et al); 3,696,572 (Jureit); and 1,297,611 (Upson).

SUMMARY OF THE INVENTION

In accordance with the invention, an improved fastener strip or fastener is provided which affords significant manufacturing advantages over the prior art yet still performs as effectively as more expensive prior art devices. The fastening strip of the invention is utilized in a manner similar to that of the Anderson et al patent discussed above, i.e., the fastening strip of the invention is used (i) in securing sheets of foamed plastic to a wall (the strips, and thus the sheets disposed therebeneath, being nailed or otherwise affixed to the walls) and (ii) as studding for covering panels of gypsum or the like which are screwed thereto.

A fastening strip constructed in accordance with the invention comprises an elongated relatively thin, generally planar metal strip having a plurality of strengthening ribs formed therein and extending along the length of the strip, and a plurality of teeth formed in the body of the strip intermediate the lateral edges thereof for securing the strip to the foamed sheeting material during the installation of the wall construction. The rib reinforced fastening strip of the invention is simpler, requires less material and cheaper to make than prior art fasteners yet possesses comparable strength. Further, the teeth formed in the body of the strip provide the necessary temporary holding power when the strip is mounted on the foamed sheeting for nailing to the wall. Thus, by virtue of this simplified construction, substantial savings can be realized as compared with prior art without loss of effectiveness in use.

In accordance with a further aspect of the invention, an improved process for manufacturing finishing strips is provided wherein a strip of metal is unwound from a coil in a roll-forming machine and a plurality of longitudinally extending ribs are formed in the strip, the process further comprising using a die to cut teeth into the web of the strip simultaneously with the passage of the strip over a roller of the roll-forming machine.

Other features and advantages of the invention will be set forth in, or apparent from, the detailed description of the preferred embodiments which follows.

DESCRIPTION OF A PREFERRED EMBODIMENT

Figure 1:
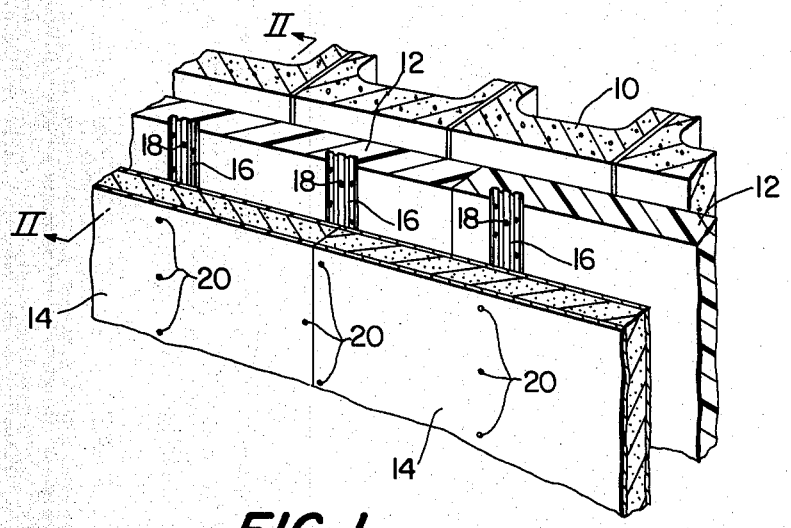
FIG. 1 is a partially exploded perspective in view of a building wall construction incorporating the fastening strips of the invention.
Figure 2:
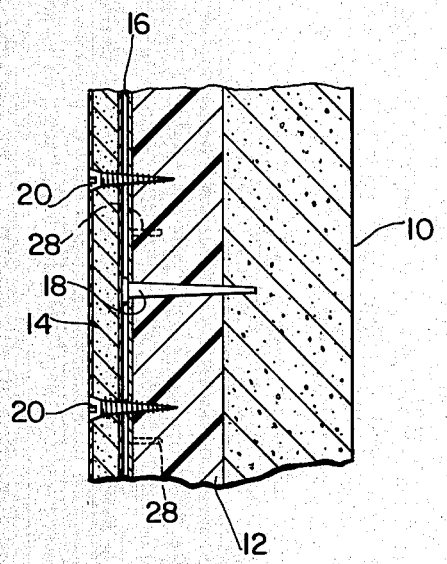
FIG. 2 is a partial cross section, to an enlarged scale, of the wall construction of FIG. 1, taken generally along line II—II of that figure.

Referring to FIG. 1, the environment of the fastening strip of the invention is shown, this environment including a concrete wall 10, intermediate sheets 12 of polystyrene foam or a like low density synthetic cellular resin sheeting material, and a pair of inner panels 14 fabricated of gypsum or the like. The fasteners of the invention, which are denoted 16, are disposed between the foam sheets 12 and the inner panels 14 and serve in securing foam sheets 12 to wall 10 as well as in forming studding to which gypsum panels 14 are affixed. More specifically, as can be best seen in FIG. 2, each of the fastening strips 16 is secured by nails, pins or the like, denoted 18, to the concrete wall 10 and thus the foam sheets 12 captured between the fastening strips 16 and wall 10 are held in place against wall 10. Further, the gypsum panels 14 are secured to the fastening strips 16 by a plurality of screws 20 (two of which are shown in FIG. 2) which extend through strips 16 into the foam sheets 12. The basic arrangement just described is generally conventional and is of the type disclosed in the Anderson patent referred to above.

Figure 3:
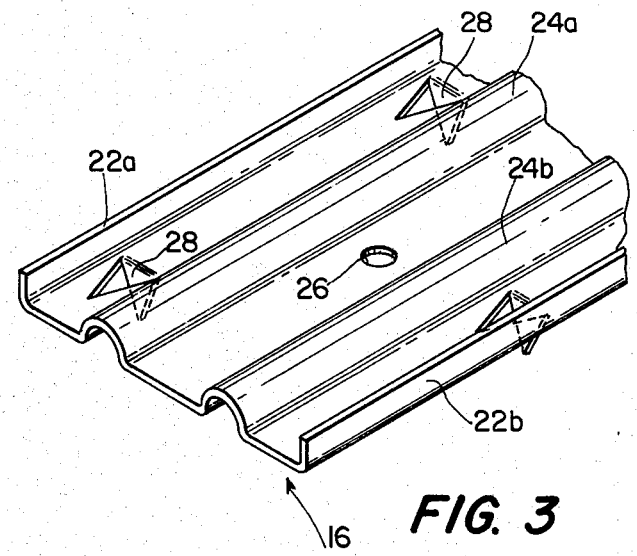
FIG. 3 is a perspective view of a fastening strip constructed in accordance with a preferred embodiment of the invention.
Figure 4:
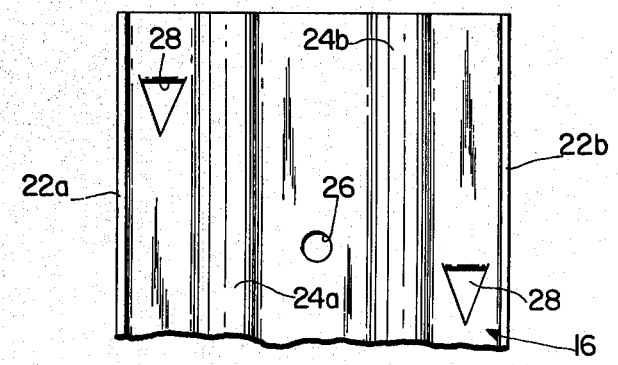
FIG. 4 is a plan view of the fastening strip of FIG. 3.

As discussed previously, the present invention concerns the fastening strips themselves and, in particular, a novel form of fastening strip which is substantially less expensive to manufacture than those of the prior art. Referring to FIGS. 3 and 4, a preferred embodiment of the fastening strips of the invention is illustrated. The basic strip itself, which is denoted 16 as in FIGS. 1 and 2, is constructed of relatively thin metal, particularly as contrasted with the prior art. These thin strips are substantially cheaper and easier to work with and can simply be formed into the required shape using very simple forming techniques. Reinforcement of the strips so as to provide the required rigidity is afforded by series of ribs, including a pair of upturned portions 22*a*, 22*b* at the longitudinal edges of the strip and a pair of intermediate ribs 24*a*, 24*b* located in spaced relation generally centrally of the strip. Strip 16 is also provided with a series of longitudinally spaced holes 26 for the nails 18 described above in connection with FIGS. 1 and 2, holes 26 being located between the ribs 24*a*, 26*b*, centrally of strip 16.

In order to provide temporary or non-permanent attachment of strips 16 to foam sheets 12 to hold the strips 16 temporarily in place on the foam sheets 12 and thereby enable the strips, and thus the foam sheets, to be nailed to the concrete wall 10, a series of triangular-shaped teeth 28 are cut, stamped or pressed out of the strip 16. These teeth 28 are adapted to be pressed into the foam sheets 12 as shown in FIG. 2 and provide adequate holding while the fastening strip 16 and the associated foam sheet 12 are nailed into the wall 10. The teeth 28 are preferably disposed in a pair of longitudinal rows between the pairs of outer and inner ribs 22*a*, 24*a* and 22*b*, 24*b* as shown in FIGS. 3 and 4.

The manner of use of the fastening strip of the invention should be evident from the foregoing. In brief, the teeth 28 of the strips 16 are pressed into the foam sheets or panels 12 and the sheets 12 are then positioned against the wall 10. Nails or the like, corresponding to nails 18, are inserted into holes 26 in strip 16 and are driven through the foam sheet 12 into the wall 10, thereby securing strips 16 to the wall 10. The gypsum panels 14 are then disposed over the fastening strips 16 and screws corresponding to screws 20 are driven through the strips 16 into the foam sheeting 12 so as to affix the panels 14 to strips 16 and thus to wall 10. In general, the length of the screws 20 is such that the screws do not extend to the wall 10.

Figure 5:
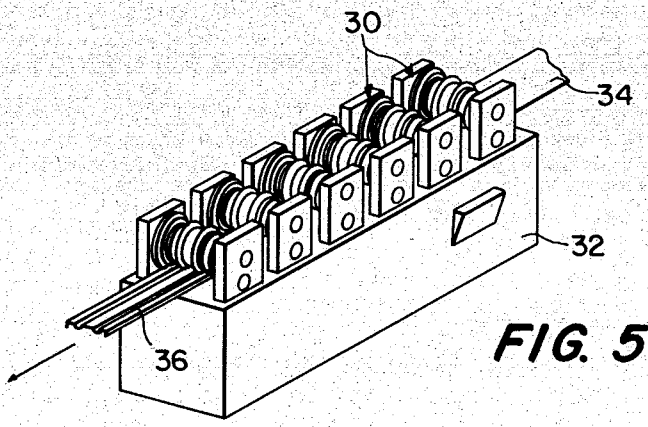
FIGS. 5, 6, 7 and 7*a* illustrate the apparatus for forming the fastening strip.
Figure 7:
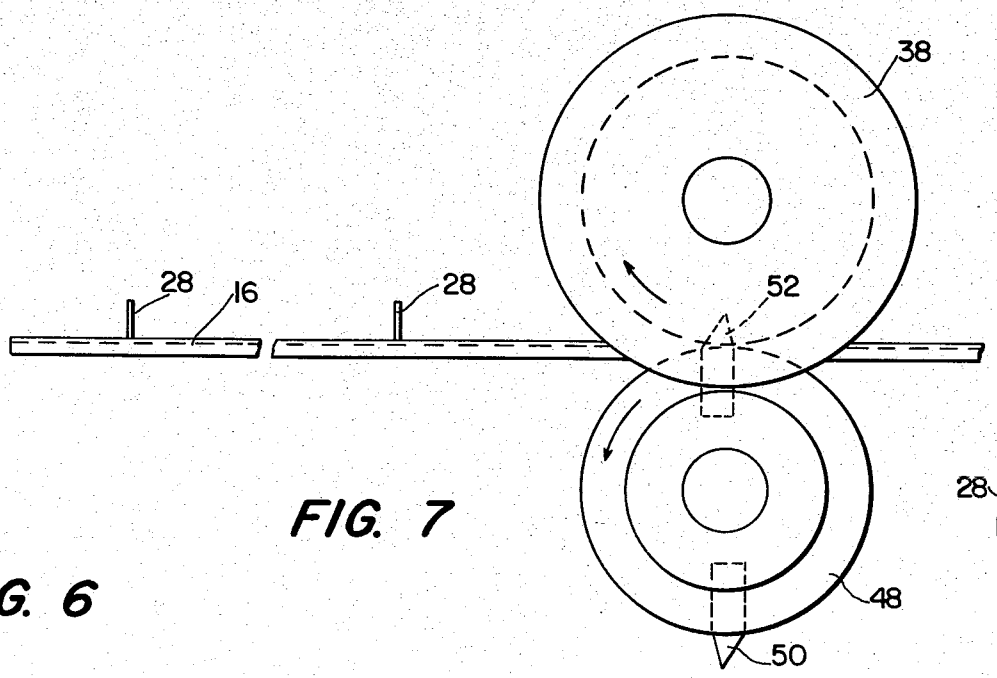
Figure 7A:
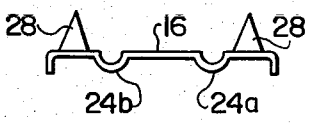
Figure 6:
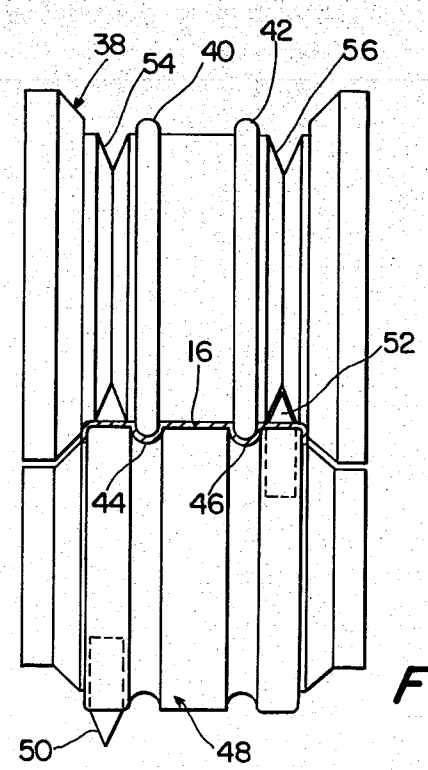

In manufacturing the fastening shown in FIGS. 3 and 4, a roll-forming machine is used and the metal strip is fed from a coil of the metal to the rollers of the machine. An important feature of this process is that a die can be used to cut out a set of the teeth 28 each time the metal strip passes around one of the rollers so that the teeth are formed in the strip at precise spacings along the strip, as determined by the size of the roller, simultaneously with the roll forming process. This technique is less time-consuming than that which would be required in manufacturing the metal stud of the Anderson patent and requires less material. Referring to FIG. 5, an exemplary embodiment of an apparatus for carrying out this process is shown. The apparatus includes a plurality of rotatable form roller stations 30 mounted on a suitable support 32 along the path of travel of a piece of flat coil stock indicated at 34. As the flat coil stock passed through the form roller stations 30 the stock is formed into the configuration shown in FIGS. 3 and 4, and teeth or lugs 28 are provided therein (the formed strip is indicated at 36 in FIG. 5). As shown in FIGS. 6 and 7, the outline shape of an upper form roller 38 includes a pair of semi-circular ridges 40 and 42 which cooperate with reciprocally shaped recesses 44 and 46 in a lower roller 48 to form the ribs 24*a*, 24*b* in the strip. Further, lower roller 48 includes a pair of punches 50 and 52 located thereon is axially spaced relation and at diametrically opposed locations. Punches 50 and 52 provide the teeth or lugs 28 in the strips, and as discussed above, are integrated with the form rollers so that a simultaneous forming and punching operation is afforded. Corresponding V-shaped circumferential slots 54 and 56 are provided in upper roller 38. The locations of the punches 50, 52 around the circumference of the roller 48 determine the locations of the teeth 28 and the arrangement shown in FIGS. 6 and 7 produces the staggered pattern shown in FIGS. 3 and 4. FIG. 7(*a*) shows an end view of a strip.

Although the invention has been described in relation to exemplary embodiments thereof, it will be understood by those skilled in the art that variations and modifications can be effected in these exemplary embodiments without departing from the scope and spirit of the invention.

We claim:

1. A process for manufacturing, from flat coil stock, a fastener strip for assisting in securing foamed sheeting to a wall and for serving as a stud for cover panels which are disposed over the foamed sheeting, said process comprising;

using a roll forming machine including upper and lower rollers to form longitudinal strengthening ribs in a strip of the flat coil stock metal as the strip is pulled from a coil of the metal, and using a rotary die arrangement to form teeth in the web of the strip of metal simultaneously with the passage of the strip past the rollers of the roll forming machine, the step of using a die arrangement comprising employing a said die arrangement including at least one punch located on one of said rollers and a correspondingly shaped circumferential recess located in the other of said rollers such that the at least one punch extends through said web into said recess when the punch forms a tooth in said web.

2. A process as claimed in claim 1 wherein said teeth are formed in said web in two rows, each row being located between a said rib and a turned edge of the web.

3. A process as claimed in claim 2 wherein said rows of teeth are formed in staggered relation with respect to one another.

4. A process as claimed in claim 1 wherein the die arrangement used in said method includes a pair of said punches and said punches are spaced laterally and circumferentially so that said die arrangement provides two staggered rows of said teeth in said web, each said row of teeth being located between a rib and a turned edge of said web.

* * * * *